United States Patent [19]

Hargassner et al.

[11] Patent Number: 4,532,981

[45] Date of Patent: Aug. 6, 1985

[54] CONTINUOUS CASTING PLANT

[75] Inventors: Reinhard Hargassner, Linz, Austria; Thomas J. Nugent, Oakland, N.J.; Alois Scheinecker, Linz; Kurt Engel, Leonding, both of Austria

[73] Assignee: Voest Alpine International Co., New York, N.Y.

[21] Appl. No.: 500,935

[22] Filed: Jun. 3, 1983

[51] Int. Cl.[3] ..... B22D 11/08; B22D 11/14

[52] U.S. Cl. ..... 164/483; 164/420; 164/425; 164/445; 164/485

[58] Field of Search ..... 164/459, 483, 491, 418, 164/420, 425, 476, 445, 443, 485, 442

[56] References Cited

U.S. PATENT DOCUMENTS

| | | | |
|---|---|---|---|
| 3,292,216 | 6/1963 | Colombo | 164/435 X |
| 3,717,197 | 2/1973 | Strack et al. | 164/420 |
| 4,069,863 | 1/1978 | Hargassner et al. | 164/436 |

*Primary Examiner*—Nicholas P. Godici
*Assistant Examiner*—Kenneth F. Berg
*Attorney, Agent, or Firm*—Horst M. Kasper

[57] ABSTRACT

There is disclosed a continuous casting machine for selectively casting a strand having slab cross section or at least two strands having smaller cross sections. It includes a plate mold surrounded by a support frame supporting the end walls and side walls, and further intermediate end walls provided between the end walls for casting at least two strands. In order to provide end walls that are insertable into the mold and positively connectable thereto with parts that project into the mold used for slab cross sectional formats being avoided, a hollow body carrying copper plates of the intermediate end walls is inserted between the copper plates of the side walls. A coolant flows through the hollow body, which is supported with its upper end on the side walls by supporting elements overlapping the side walls, and with its lower end is fixed by coolant supply and discharge piping. The coolant supply and discharge piping project from the support frame as far as into the hollow body, and extend transversely to the side walls and below the same. Each pipe is displaceable from the operating position projecting into the hollow body into a resting position releasing the hollow body. In a method of starting a continuous casting plant the intermediate end walls are removed from the mold prior to the onset of casting. A starter bar serving for strands having slab cross sections and including at least two starter bar heads is threaded through the mold from above into a strand guide arranged below the mold. Thereupon the intermediate end walls are inserted into the mold and fixed thereto.

7 Claims, 4 Drawing Figures

CONTINUOUS CASTING PLANT

The invention relates to a continuous casting machine for selectively casting a strand having slab cross ection or at least two strands having smaller cross sections; comprising a plate mold surrounded by a main frame supporting the end walls and side walls, further intermediate end walls being provided between the end walls for casting at least two strands, as well as to a method of starting up a continuous casting plant.

There is often the desire to cast in one and the same continuous casting machine, two or more strands having the same or different cross sections, wherein the mold utilized for the larger strand cross sections is to be utilized as well for smaller strand cross sections. For this purpose, it is known for a machine of the above kind (U.S. Pat. No. 3,292,216) to insert one or more intermediate end walls between the end walls of a mold destined for a slab cross sectional format, so that two or more adjacently arranged strands of smaller cross sections can be cast simultaneously with the mold that has been dimensioned in accordance with the slab cross sectional format. A problem involved therein is the fastening of, and coolant supply to, the intermediate end walls additionally arranged between the side walls, to which no solution has been suggested in U.S. Pat. No. 3,292,216.

If one wishes to fix the intermediate end walls only by the clamping force applied from the side walls, as is provided according to U.S. Pat. No. 3,292,216, a definite position of the intermediate end walls, in particular during the operation of the mold, cannot be determined.

From U.S. Pat. No. 3,717,197 a fastening means for the additionally inserted intermediate end walls is known, according to which a fixed intermediate wall is inserted between the side walls and fastened thereto.

A problem results from the fixation of the intermediate end walls, wherefor, according to U.S. Pat. No. 3,717,197, bolts extending transversely across the cavity of the mold are provided above and/or below the mold. This has the disadvantage that, if a top fed starter bar is to be threaded through the mold—a separate starter bar is required for each mold part at the onset of casting, and it is not possible to use the starter bar that has been used when applying the mold to the casting of strands having slab cross sections.

The invention aims at avoiding these disadvantages and difficulties and has as its object to provide a continuous casting machine mold, in which intermediate end walls to be inserted into the mold are positively connectable with the mold, wherein, however, parts that project into the mold used for slab cross sections are avoided. Furthermore the intermediate end walls are to be removable from, and installable into, the mold in a time-saving manner.

This object is achieved according to the invention in that, between the copper plates of the side walls, a hollow body carrying, on both sides, copper plates of the intermediate end walls is inserted, through which a coolant flows and which, on the one hand, is supported with its upper end on the side walls by means of supporting elements overlapping the side walls and, on the other hand, with its lower end, fixed by coolant supply and discharge piping projecting from the support frame, as far as into the hollow body, the coolant supply and discharge piping extending transversely to the side walls and below the same and each being displaceable from the operating position projecting into the hollow body into a resting position releasing the hollow body.

According to a preferred embodiment, the coolant supply and discharge piping are displaceably mounted in the support frame. It is not necessarily required that the coolant supply and discharge piping be displaceably mounted on the support frame; these pipes also might be rigidly mounted in the support frame and lengthenable and shortenable in a telescopic manner on their free ends, thus being insertable into, and removable from, the hollow body. The displaceable mounting in the support frame, however, is preferred for structural reasons.

For the purpose of greater stability of the mold provided with intermediate end walls, the coolant supply and discharge piping are guided by means of guides arranged on the lower sides of the side walls.

In order to prevent the leak of coolant with the coolant supply and discharge piping displaced into the resting position, the coolant supply and discharge piping, in the resting position, suitably abut on a seal closing the conduits with their ends inserted into the support frame.

In order to safely support the strand skin, it is common to provide foot rollers fastened to the mold immediately below the mold, which reciprocate together with the mold. For this purpose, the foot rollers of the intermediate end walls hitherto have been mounted to the supporting structures of the side walls of the mold and not to the intermediate end walls, these foot rollers thus having had to be removed and installed separately during the removal and installation of the intermediate end walls. The invention furthermore has as its object to avoid separate manipulations for the foot rollers of the intermediate end walls when readjusting the mold or introducing the starter bar from above through the mold, which object is solved in that the hollow body, on its lower end, is provided with a console carrying foot rollers and whose width is smaller than the distance of the side walls.

An advantageous method of starting up a continuous casting machine is characterized in that, prior to the onset of casting, the intermediate end walls are removed from the mold, a starter bar serving for initiating casting of strands having slab cross sectional formats and including at least two starter bar heads is threaded through the mold from above into a strand guide arranged below the mold, whereupon the intermediate end walls, in particular commonly with the foot rollers fixed to them, are reinserted into the mold and fixed thereto.

The invention will now be explained in more detail by way of one embodiment illustrated in the accompanying drawings, wherein.

Figure 2:
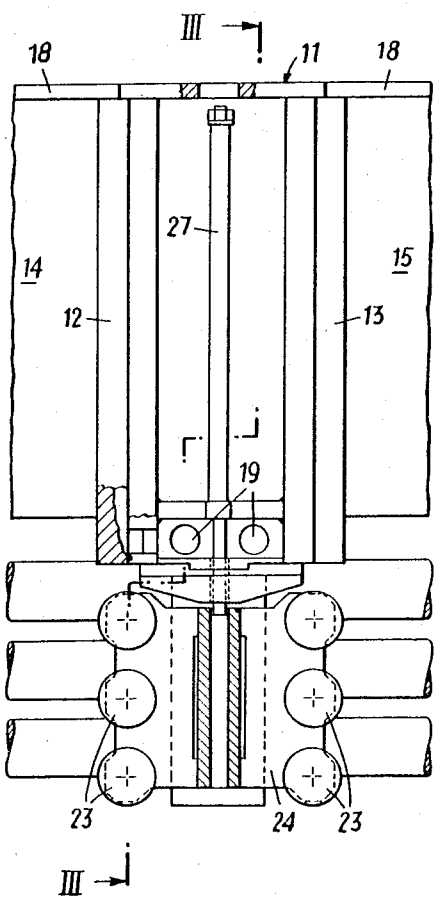
FIG. 2 is a section along line II—II.
Figure 4:
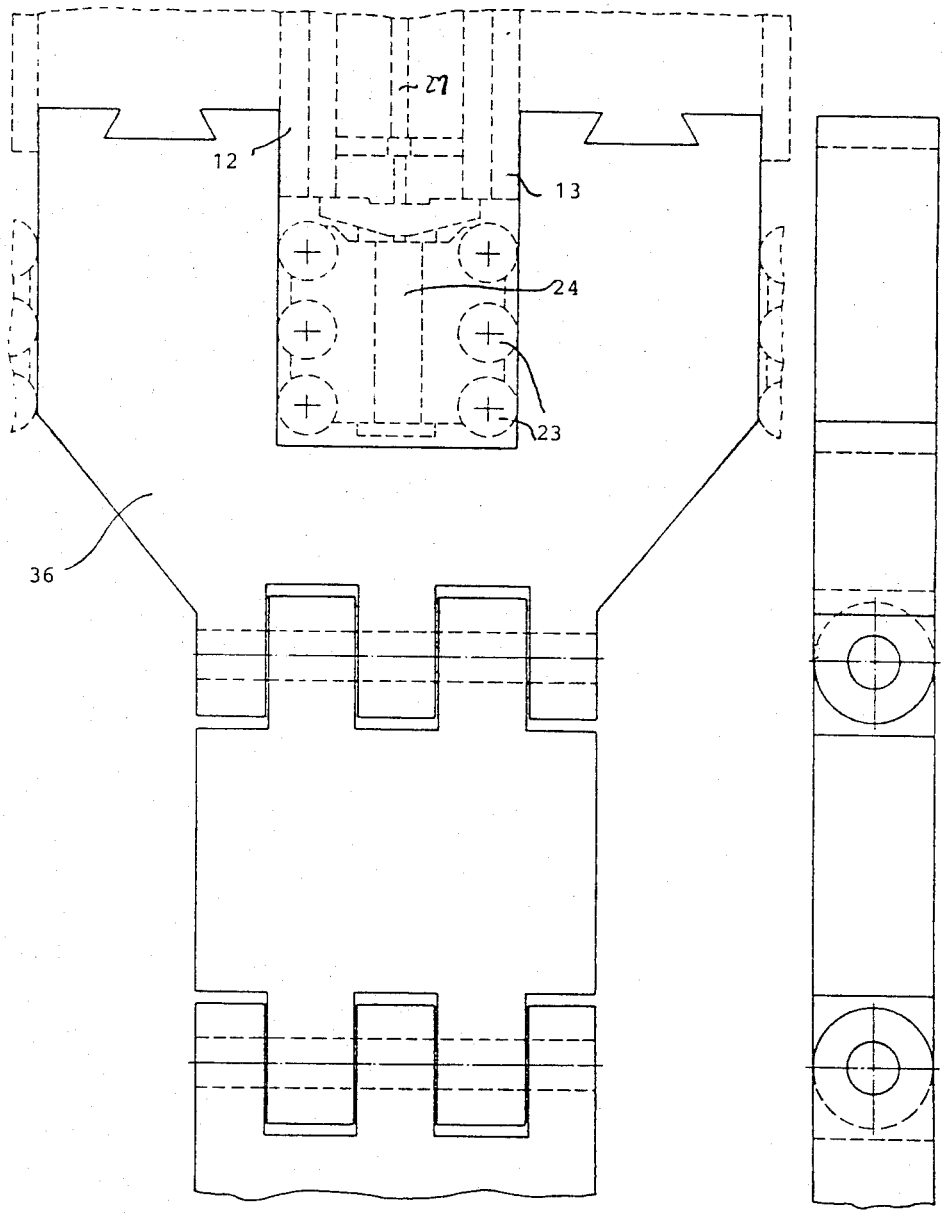

FIG. 4 is a schematic view analogous to FIG. 2 with a schematic starter bar. On an oscillating table (not illustrated) of a plate mold, a support frame 1 surrounding the side and end walls of the mold is positioned. On this support frame 1, the side walls 2, 3 and the end walls 4, 5 of the mold are supported in a manner not illustrated in detail, for instance, as described in U.S. Pat. No. 4,069,863. The side walls 2, 3 are each formed by a hollow supporting structure 6, 7 to which continuous copper plates 8, 9 extending along the mold cavity side are mounted. The side walls 2, 3, like the end walls 4, 5 are supplied with coolant from the support frame 1 in a manner not illustrated in detail, for instance, according to U.S. Pat. No. 4,069,863.

For casting two strands with this mold, a hollow body 11 is inserted in the mold cavity 10 between the end-side end walls 4, 5 which hollow body, on both sides, is provided with copper plates 12, 13 forming intermediate end walls, the mold cavity 10 having slab cross sectional format thus being divided into two smaller mold cavities 14, 15, e.g., to cast strands having small slab and bloom cross sections.

Figure 1:
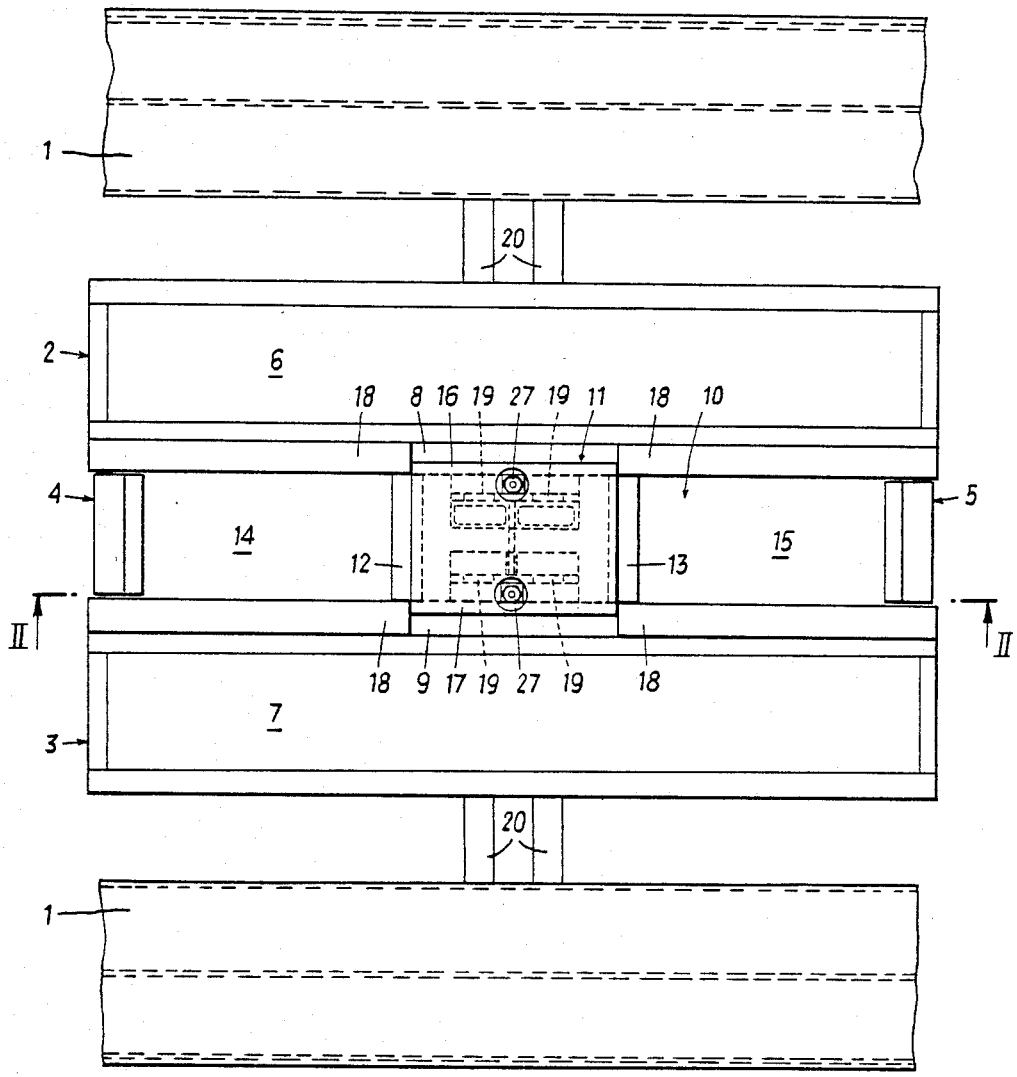
FIG. 1 is a top view of the mold.

The hollow body 11 carrying the intermediate end walls 12,13 is supported on the upper side of the mold by holding means 16, 17 projecting beyond the side walls 2, 3, which holding means, as can be seen from FIG. 1, are secured against displacement in the horizontal direction by means of ledges 18 extending along the side walls. The lower end of the hollow body 11 exceeds the side walls 2, 3 and, on the exceeding end, comprises recesses 19, preferably bores equipped with packing rings 19', viz. two adjacently arranged recesses 19 on each side that is directed to a side wall 2, 3. Into these recesses 19, coolant supply and discharge pipes 20 displaceably mounted in the support frame 1 are insertable.

Figure 3:
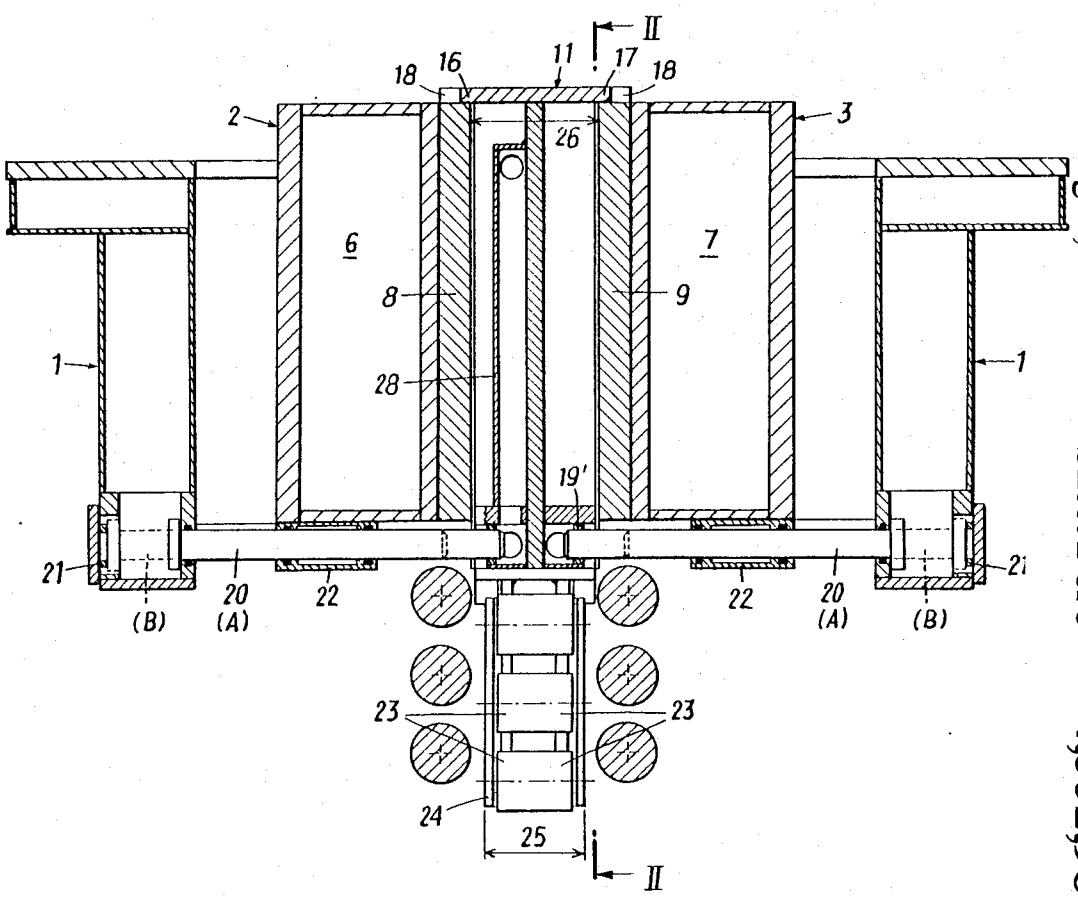
FIG. 3 is a section along line III—III.

In FIG. 3 the operating position A of the coolant supply and discharge pipes 20 has been entered in full lines. If the coolant supply and discharge pipes are inserted in the recesses 19, the lower end of the hollow body 11 is held in the right position and is secured against displacement in the horizontal direction and against upward lifting. Whenever the coolant supply and discharge pipes are displaced into the resting position B illustrated in FIG. 3 by broken lines, the hollow body 11 can be pulled upwardly out of the mold without further manipulations being necessary.

In the resting position B the end of each conduit 20, inserted in the support frame 1, projects against a seal 21 arranged within the waterbox, so that a flowing out of coolant through the conduits 20 is prevented. The coolant supply and discharge pipes 20, for the purpose of a greater stability, are guided by means of guides 22 arranged on the lower side of the backup plates of the side walls.

The foot rollers 23 allocated to the intermediate end walls 12, 13 are fastened to a console 24 whose width extension 25, as can be seen from FIG. 3, is smaller than the distance 26 between the side walls 2, 3, whereby the foot rollers 23 allocated to the intermediate end walls can be removed simultaneously with the removal of the hollow body 11. The console 24 holding the foot rollers is supported on the lower side of the hollow body 11 and is fixed to the same by means of screws 27 guided to near the upper edge of the hollow body 11. Webs 28 that serve to guide the coolant are welded into the interior of the hollow body 11.

The arrangement functions in the following manner:

If one wants to start casting at least two strands in the mold designed for a slab cross sectional format, at first a starter bar as used for initiation of casting strands having slab cross sectional formats is threaded from above through the mold into the strand guide. This starter bar, however, comprises several heads shaped in accordance with the desired smaller strand cross sections. After the starter bar has been lowered into the mold, one (or more) hollow body(ies) 11 are inserted through the mold with the intermediate end walls 12, 13 and are fixed in the mold by displacing the coolant supply and discharge conduit means 20 from the resting position B into the operating position A while simultaneously inserting them into the recesses 19, whereupon casting may be started in the usual way.

What we claim is:

1. In a continuous casting machine to be used for selectively casting a single strand having slab cross section or at least two strands having smaller cross sections, and of the type including a plate mold having side walls and end walls including side wall copper plates and end wall copper plates, a support frame surrounding said mold and carrying said side and end walls, and further intermediate end walls having copper plates provided between said end walls for casting at least two strands, the improvement which comprises a hollow body carrying said intermediate end wall copper plates on both sides and inserted between said side wall copper plates, means for supplying a coolant flowing through said hollow body, supporting elements overlapping said side walls and supporting, on said side walls, said hollow body on its upper end, and coolant supply and discharge piping projecting from said support frame as far as into said hollow body and fixing said hollow body on its lower end, said coolant supply and discharge piping extending transversely to, and below, said side walls and being displaceable from an operating position projecting into said hollow body into a resting position releasing said hollow body.

2. A continuous casting machine as set forth in claim 1, wherein said coolant supply and discharge piping are displaceably mounted in said support frame.

3. A continuous casting machine as set forth in claim 2, further comprising guides arranged on the lower side of said side walls for guiding said coolant supply and discharge piping.

4. A continuous casting machine as set forth in claim 2, further comprising a seal closing said coolant supply and discharge piping, and wherein said coolant supply and discharge piping, in said resting position, abut on said seal with their ends inserted in said support frame.

5. A continuous casting machine as set forth in claim 1, 2, 3 or 4, further comprising a console provided on said hollow body on its lower end and having a width that is smaller than the distance of said side walls, and foot rollers arranged on said console.

6. A method for starting up a continuous casting machine including a plate mold having side walls and end walls including side wall copper plates and end wall copper plates, a support frame surrounding said mold and carrying side and end walls, further intermediate end walls having copper plates provided between said end walls for casting at least two strands, a hollow body carrying said intermediate end wall copper plates on opposite sides and inserted between said side copper plates, means for supplying a coolant flowing through said hollow body, supporting elements overlapping said side walls and supporting, on side walls, said hollow body on its upper end, and coolant supply and discharge piping projecting from said support frame as far as into said hollow body and fixing said hollow body on its lower end, said coolant supply and discharge piping extending transversely to, and below, said side walls and being displaceable from an operating position projecting into said hollow body, which method comprises the steps of removing said intermediate side walls from said mold prior to the onset of casting, threading a starter bar serving for casting strands having slab cross sectional formats and including at least two starter bar heads from above, through said mold, into a strand guide arranged below said mold, inserting said intermediate end walls into said mold and fixing them to said mold, and casting molten metal into the mold.

7. A method for starting up a continuous casting machine as set forth in cliam 6, further comprising providing foot rollers fixed to the intermediate end walls;

inserting said hollow body with the affixed foot rollers into said mold; and fixing said hollow body with the affixed foot rollers to said mold.

* * * * *

UNITED STATES PATENT AND TRADEMARK OFFICE

CERTIFICATE OF CORRECTION

PATENT NO. : 4,532,981

DATED : Aug. 6, 1985

INVENTOR(S) : Hargassner et al

It is certified that error appears in the above-identified patent and that said Letters Patent are hereby corrected as shown below:

(73) Assignee: VOEST-ALPINE International Corporation, New York, N.Y.

Signed and Sealed this

*Twenty-fifth* Day of *February 1986*

[SEAL]

*Attest:*

DONALD J. QUIGG

*Attesting Officer*

*Commissioner of Patents and Trademarks*